US011453140B2

(12) United States Patent
Barrer

(10) Patent No.: US 11,453,140 B2
(45) Date of Patent: Sep. 27, 2022

(54) APPARATUS FOR PROCESSING FLAT OBJECTS

(71) Applicant: MULTIGRAF AG, Muri (CH)

(72) Inventor: Robert Barrer, Muri (CH)

(73) Assignee: MULTIGRAF AG, Muri (CH)

( * ) Notice: Subject to any disclaimer, the term of this patent is extended or adjusted under 35 U.S.C. 154(b) by 21 days.

(21) Appl. No.: 16/750,159

(22) Filed: Jan. 23, 2020

(65) Prior Publication Data

US 2020/0238554 A1 Jul. 30, 2020

(30) Foreign Application Priority Data

Jan. 29, 2019 (EP) ..... 19154349

(51) Int. Cl.
*B26D 1/24* (2006.01)
*B26D 1/18* (2006.01)
(Continued)

(52) U.S. Cl.
CPC ..... *B26D 1/245* (2013.01); *B26D 1/185* (2013.01); *B26D 7/2621* (2013.01);
(Continued)

(58) Field of Classification Search
CPC ..... Y10T 83/9312; Y10T 83/0215; Y10T 83/0222; Y10T 83/0267; Y10T 83/0281; Y10T 83/0289; Y10T 83/0304; Y10T 83/0311; Y10T 83/0333; Y10T 83/0363; Y10T 83/7868; Y10T 83/7872;
(Continued)

(56) References Cited

U.S. PATENT DOCUMENTS 4,252,044 A * 2/1981 Yamashita ..... B26D 7/2635 83/425.4
4,269,097 A * 5/1981 Linn ..... B26D 7/2635 493/370

(Continued)

FOREIGN PATENT DOCUMENTS

EP 0354515 A1 2/1990
EP 0922543 A2 6/1999
EP 2161113 A1 3/2010

OTHER PUBLICATIONS

Jul. 16, 2019 Search Report issued in European Patent Application No. 19154349.5.

*Primary Examiner* — Phong H Nguyen
(74) *Attorney, Agent, or Firm* — Oliff PLC

(57) ABSTRACT

The apparatus for processing flat objects includes a transport system with several rotatably mounted conveyor rollers, the flat objects transportable in the direction of transport, and at least one releasably mounted tool module releasably coupled to only one drive shaft or to a lower and an upper rotatably mounted drive shaft; is supported displaceable along the only one drive shaft or the lower and the upper drive shaft; and is equipped with tool parts for processing the flat objects, of which at least one is drivable by the lower or the upper drive shaft. The tool module is supported by a tool carrier which is displaceable by means of a rotatably mounted setting shaft in parallel to the only one drive shaft
(Continued)

Figure 1:
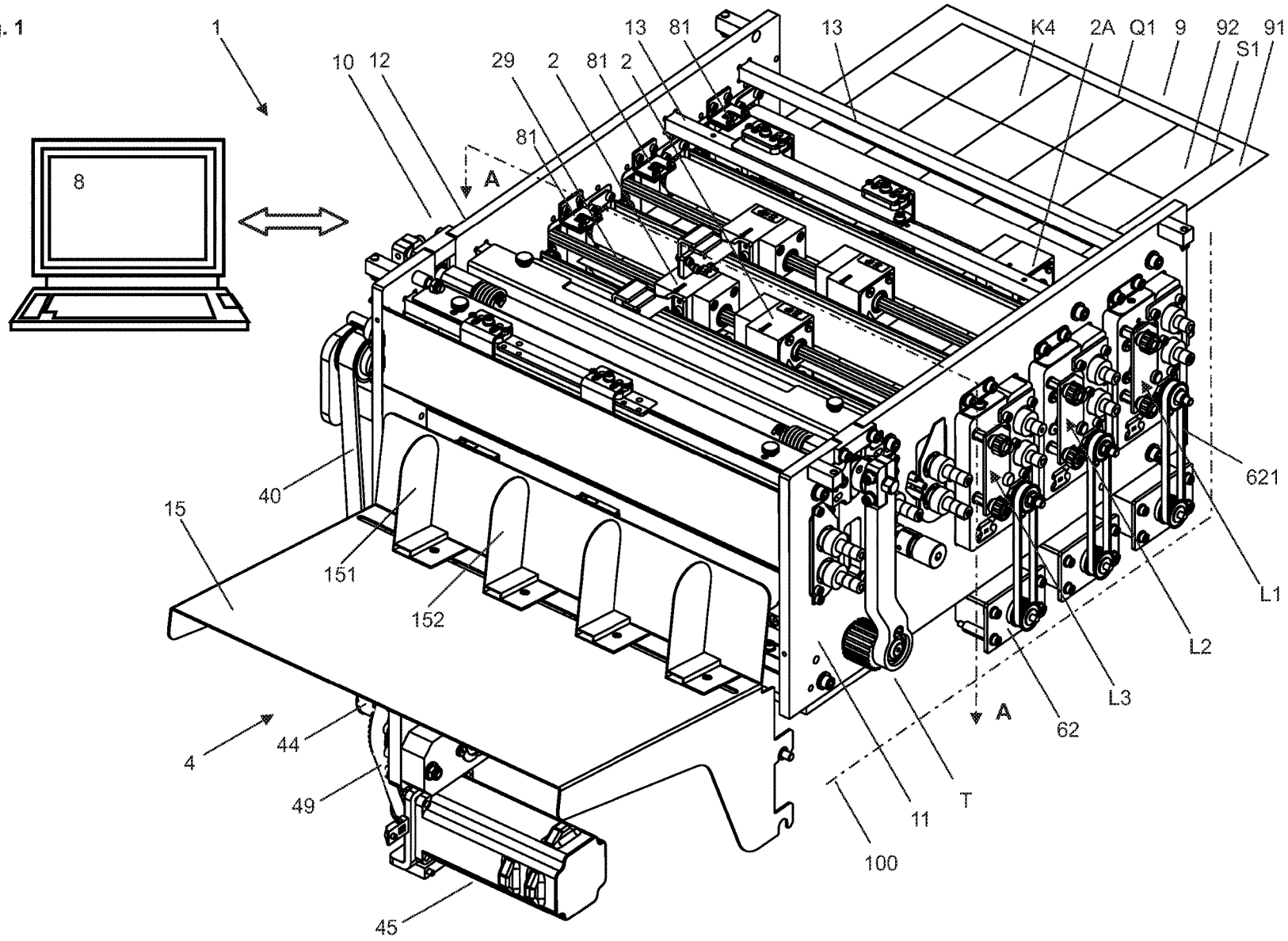

and to the lower and the upper drive shafts, and which tool carrier has at least one holding element which serves for releasably holding the tool module.

16 Claims, 8 Drawing Sheets

(51) Int. Cl.
*B26D 7/26* (2006.01)
*B65H 35/02* (2006.01)

(52) U.S. Cl.
CPC ..... *B26D 7/2635* (2013.01); *B65H 35/02* (2013.01); *B26D 2007/2657* (2013.01); *B65H 2402/30* (2013.01)

(58) Field of Classification Search
CPC .... Y10T 83/7876; B26D 1/245; B26D 1/185; B26D 1/24; B26D 1/14; B26D 1/141; B26D 1/143; B26D 1/1435; B26D 1/18; B26D 7/2621; B26D 7/2635; B26D 7/2628; B26D 7/26; B26D 2007/2657; B65H 35/02; B65H 35/04; B65H 2402/30
See application file for complete search history.

(56) References Cited

U.S. PATENT DOCUMENTS

| | | | | |
|---|---|---|---|---|
| 4,604,934 | A * | 8/1986 | Elliott | C03B 33/027 83/498 |
| 4,627,214 | A * | 12/1986 | Anderson | B26D 7/2635 53/71 |
| 4,976,676 | A | 12/1990 | Mensing et al. | |
| 5,787,780 | A | 8/1998 | Carter | |
| 6,071,222 | A | 6/2000 | Schneider | |
| 8,342,068 | B2 * | 1/2013 | Adami | B26D 7/2635 83/498 |
| 2001/0009121 | A1 * | 7/2001 | Benzoni | B26D 3/14 83/499 |
| 2003/0226435 | A1 * | 12/2003 | Aoki | B26D 7/2635 83/34 |
| 2008/0258379 | A1 | 10/2008 | Oota et al. | |
| 2009/0120263 | A1 * | 5/2009 | Suzuki | B26D 7/2642 83/73 |
| 2010/0059316 | A1 | 3/2010 | Waldeck et al. | |
| 2013/0152750 | A1 * | 6/2013 | Chilcott | B26D 7/2635 83/56 |
| 2015/0273720 | A1 * | 10/2015 | Endo | B26D 1/245 83/425.1 |
| 2018/0079097 | A1 | 3/2018 | Oiwa et al. | |
| 2018/0370059 | A1 | 12/2018 | Hsu | |

* cited by examiner

APPARATUS FOR PROCESSING FLAT OBJECTS

The invention relates to an apparatus with tool modules for processing, in particular for cutting, flat objects, such as paper sheets, cardboard, or plastic films.

[1], U.S. Pat. No. 5,787,780A, discloses an apparatus with movable tool modules, by means of which paper sheets transported in the apparatus can be perforated or cut in the direction of transport.

[2], US2008258379A1 and [3], US2018079097A1, disclose apparatuses for processing paper sheets, which have several processing modules that are individually detachable from the apparatus and which include tool modules that serve for processing paper sheets.

In [3] processing modules with tool modules for cutting paper sheets are disclosed, which have an upper housing part for holding an upper rotary blade and a lower housing part for holding a lower rotary blade. The upper and the lower housing part of the tool modules are detachably connected by a connecting plate. The rotary blades are mounted on one side in such a way that their blades cooperate peripherally and can divide a sheet of paper passing between the housing parts. Two bearing shafts pass through the upper housing part and a drive shaft passes through the lower housing part and the lower rotary blade. The lower rotary blade is driven by the drive shaft and causes the rotation of the lower rotary blade during operation.

For changing the tool modules, the relevant processing module, which comprises the tool modules, is removed from the apparatus. Afterwards, screws of bearing elements on the processing module are loosened, so that the two bearing shafts and the drive shaft can be removed from the processing module and reinserted for removing and reinstalling the tool modules, which are held manually during this process. When reinserting the bearing shafts and the drive shaft, the tool modules are held in their respective positions. Then the bearing elements are mounted and the processing module is reinstalled. The process of replacing the tool modules involves therefore numerous steps that require technical knowledge, skill and a relatively large amount of time.

The tool modules can be moved to any position along the bearing shafts on the drive shaft using a threaded shaft. For this purpose, the housing of the tool modules includes a fork-shaped threaded wheel, which is pierced by the threaded shaft and can be automatically rotated by means of a drive motor, and can thus move along the threaded shaft together with the tool module. The tool module must therefore be equipped with a drive motor and supplied with electric power to enable automatic displacement. The automated tool modules are therefore relatively complex in design. It should also be noted that for replacing the automated tool modules, the threaded shaft must also be loosened and remounted, which increases the effort required.

It should further be noted that the cutting operations of the apparatuses according to [1], [2] and [3] are carried out at high cadence, which requires precise guidance of the paper sheets to achieve the desired cutting quality. In the apparatus of [3], the connecting plate, which connects the upper and the lower part of the tool modules, is designed to be released in order to move the two parts of the housing towards each other, so that the rotary blades can work together optimally. This adjustment must be carried out precisely and may have to be repeated several times if the desired cutting quality is not achieved. The adjustment of all tool modules can take considerable time.

The present invention is therefore based on the object of creating an improved apparatus with tool modules for processing, in particular for cutting, flat objects.

The apparatus shall have a simple construction, require little maintenance and shall be configured and operated with little effort.

Mounting and dismounting of the tool modules shall be performed easily with little effort. Maintenance work or changes to the configuration of the apparatus for carrying out different processing operations shall be carried out quickly and conveniently with only a few working steps.

It shall be possible to execute the individual steps for uninstalling and installing the tool modules sequentially and conveniently by selective access to the apparatus at suitable points. Simultaneous access to several parts of the apparatus, which usually causes difficulties and requires special skills, shall be avoided when performing maintenance work or changing the configuration of the apparatus.

The apparatus should allow guidance and processing of flat objects with high precision and high quality. The cuts shall be performed precisely while the flat objects are handled smoothly. A high processing quality should be achieved without the need for prior adjustments.

This task is solved with an apparatus according to claim 1. Advantageous features of the invention are specified in further claims.

The apparatus, which serves for processing flat objects, such as paper sheets, cardboard, foils, plastic films and the like, comprises a transport system with several rotatably mounted conveyor rollers, with which the flat objects are transportable in the direction of transport, and at least one releasably mounted tool module, a) which is releasably coupled to only one drive shaft or to a lower and an upper rotatably mounted drive shaft;
b) which is supported displaceable along the only one drive shaft or the lower and the upper drive shaft; and
c) which is equipped with tool parts for processing the flat objects, of which tool parts at least one is drivable by the lower or the upper drive shaft.

According to the invention the tool module is supported by a tool carrier which is displaceable by means of a rotatably mounted setting shaft in parallel to the only one drive shaft or in parallel to the lower and the upper drive shafts, and which tool carrier has at least one holding element which serves for releasably holding the tool module.

Figure 2A:
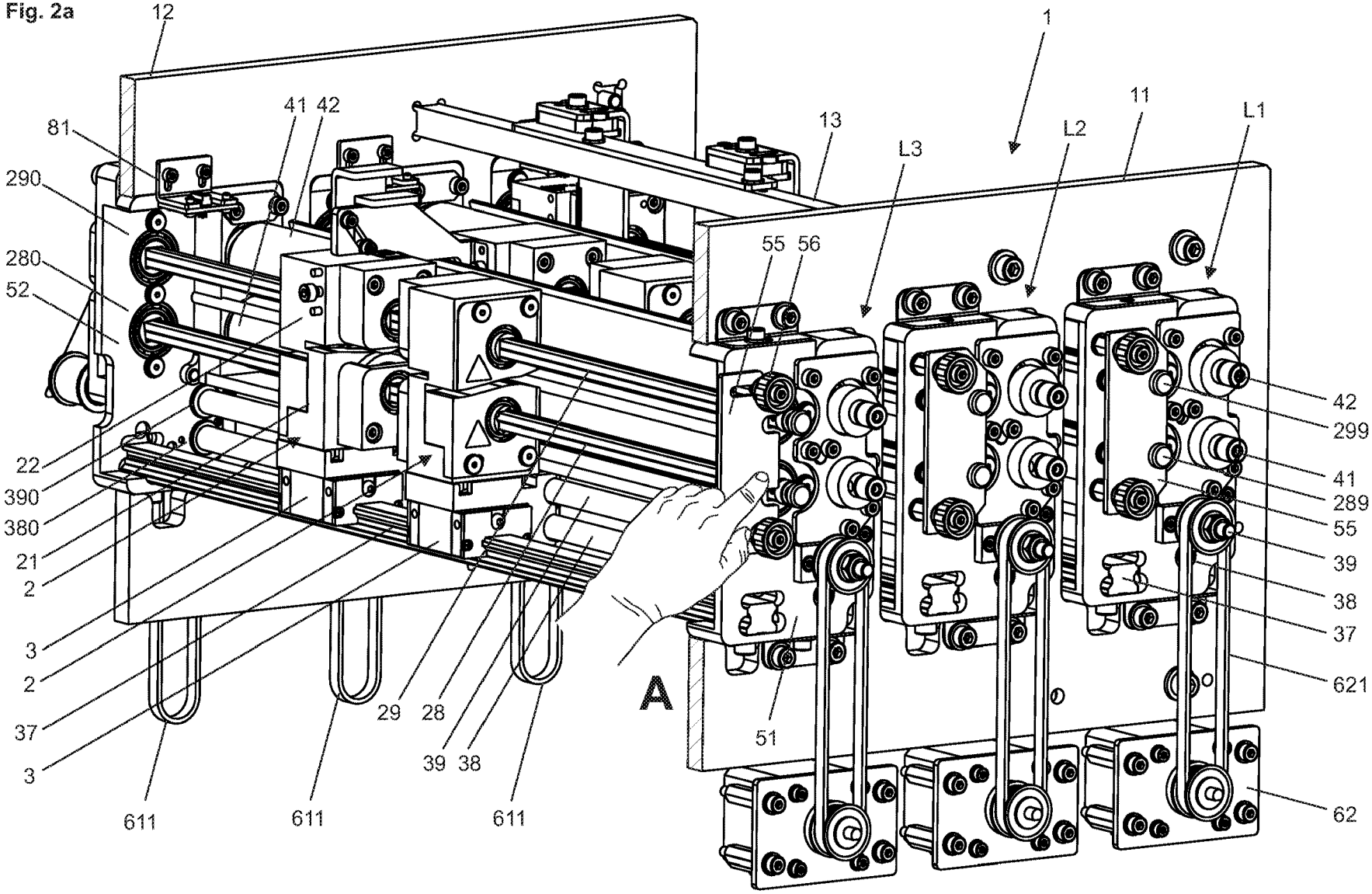
Figures 2B, 2C:
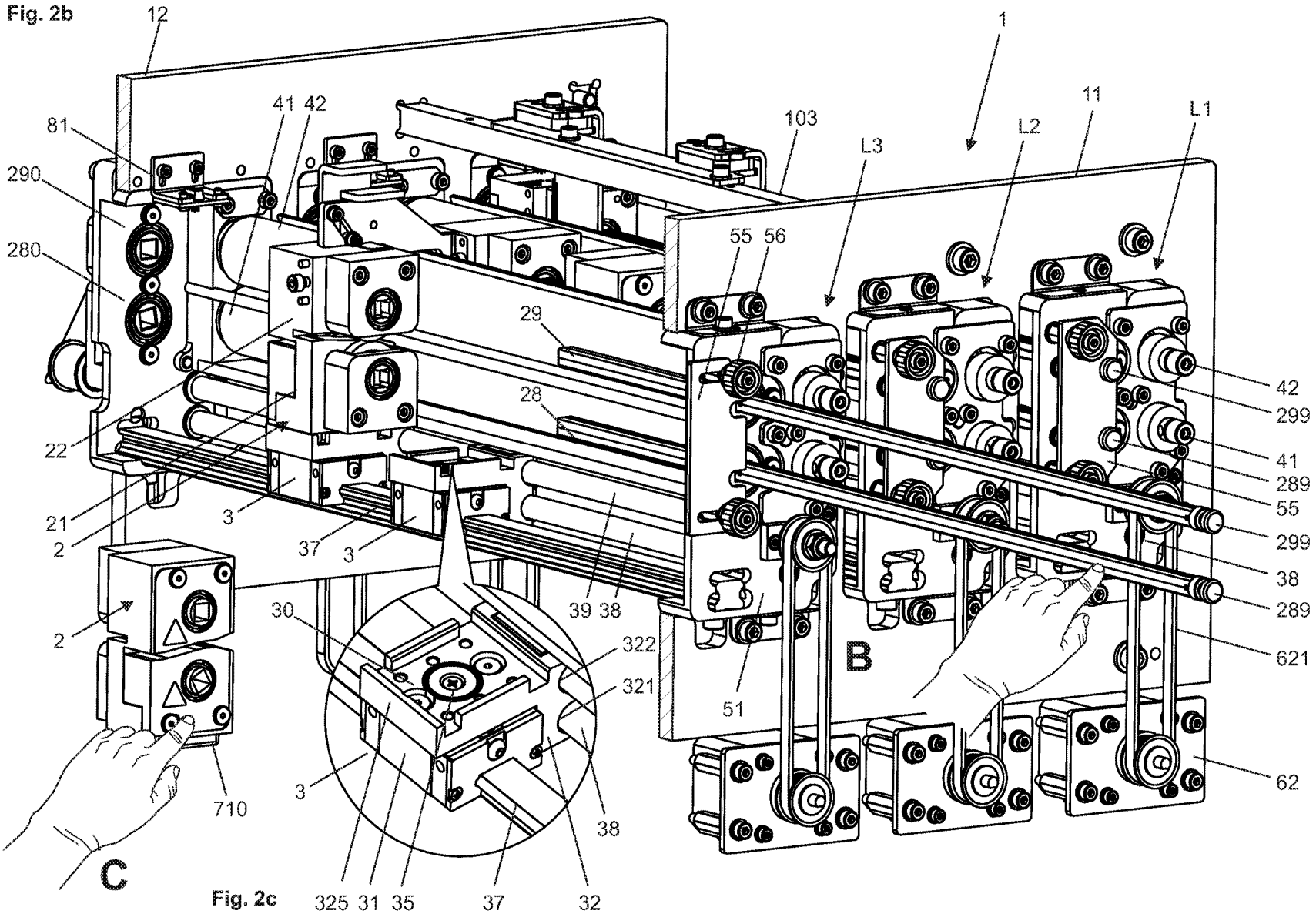

Hence, the only one drive shaft or the lower and upper drive shaft can be detached from the coupled tool module or several coupled tool modules, while the tool module or tool modules are held by the associated tool carrier (see FIG. 2*b*). As the setting shafts are connected to the tool carriers, the tool modules can be changed without removing the setting shafts. The tool modules can therefore be released by pulling the at least one drive shaft or the lower and upper drive shaft out of the unit. For example, the drive shafts can be removed from the front of the unit without having to hold the tool modules held by the tool carriers in any other way, e.g. with one hand.

In preferred embodiments, the only one drive shaft or the lower and the upper drive shaft each are held rotatably and axially displaceable at their front end in a front bearing plate and at the rear in a rear bearing plate. Preferably, the only one drive shaft or the lower and the upper drive shaft are provided with a locking piece at the front, which can be detachably coupled with a locking part held by the front bearing plate. During operation of the unit, the rotatably mounted drive shafts are therefore held axially non-displaceable.

After unlocking the locking part, the drive shafts can easily be pulled out of the front of the unit, thereby releasing the tool modules. Access to the tool modules released from the drive shafts is gained by opening a cover on the housing of the unit. The tool modules can now be conveniently grasped, detached from the tool carriers and, e.g. after maintenance work or reconfiguration, reinstalled on the tool carriers. After the tool modules have been reattached, the drive shafts can be pushed back into the apparatus and coupled with the newly inserted tool modules. This procedure can also be performed conveniently. If the drive shafts are axially guided, this is achieved by simple axial displacement.

An exchange of tool modules can therefore be carried out sequentially in a few steps by selective access to individual device parts. Simultaneous access to several parts of the device, e.g. holding the tool modules while the drive shafts are pulled out or pushed in, is not necessary.

After inserting the drive shafts, the position of the tool modules can be adjusted by actuating the setting shafts or motors connected to the setting shafts, whereby the tool carriers and the tool modules held by them can be automatically moved to desired positions to perform the specified tasks.

The tool carriers allow the tool modules to be stabilized so that flat objects can be processed with greater precision. For optimal guidance of the tool modules, the tool carrier is provided with a slide part, which can be moved along a guide rail parallel to the setting shaft and parallel to the lower and upper drive shafts. The slide part is supported on the guide rail and/or positively connected to the guide rail. Preferably, the slide part has a receiving channel on the side facing the guide rail into which the guide rail can be inserted. Preferably the receiving channel and the guide rail have corresponding cross-sections that interlock with each other. For example, the guide rail has a T-shaped cross-section which is held positively within the receiving channel. When replacing the tool modules, the tool carrier is therefore held stable. When the tool modules are in operation, they are supported by the tool carriers so that the machining processes, especially cutting processes, can be carried out precisely.

The tool carrier can have any kind of holding elements by means of which the tool modules can be held reliably, preferably free of play. For example, the tool carrier is provided with a collar into which a socket provided on the underside of the tool module can be inserted. In addition or alternatively, locking elements can be provided which allow the tool modules to be locked into the tool carrier and released again e.g. by applying force. For example, the base can be enclosed by an elastic ring which can engage in a circumferential groove or in groove elements on the inside of the collar. Preferably, magnetic elements on the tool module and the associated tool carrier are designed to attract each other. The tool carrier can, for example, be provided with at least one permanent magnet that interacts with ferromagnetic or paramagnetic elements of the tool module. Alternatively, the permanent magnet can also be connected to the tool module. Furthermore, the tool modules and the tool carrier can each be equipped with a permanent magnet. The holding elements are preferably used in combination. The mechanical holding elements are preferably used to hold the tool module in a form-fit lateral position on the support of the tool module, while the at least one magnetic holding element ensures that the tool modules can only be lifted vertically with the appropriate amount of force.

In preferred configurations, the tool module has a lower module part with a lower tool part detachably coupled to the lower drive shaft, and an upper module part with an upper tool part detachably coupled to the upper drive shaft. The lower tool part and the upper tool part preferably have identical diameters, which are selected such that the lower tool part can act on the flat object from below and the upper tool part from above.

The processing of a flat object, e.g. a sheet of paper, is done with highest precision if the flat object is aligned in a plane. However, the tool parts can deform the flat object and affect the quality of the flat object processing. In order to avoid such problems, the invention provides that the lower tool module has at least one lower guide wheel detachably coupled to the lower drive shaft, and that the upper tool module has at least one upper guide wheel detachably coupled to the upper drive shaft. It is further provided that the lower and the upper guide wheel preferably have identical diameters, which are selected such that the lower guide wheel can act on the flat object from below and the upper guide wheel from above. Since the guide wheels are displaced preferably only by a small distance of e.g. 5 mm to 25 mm from the tool parts, it is ensured that the flat object is guided in a plane in the area of the tool parts. The machining of the flat object held in one plane can therefore be performed with maximum precision.

For the precise arrangement and alignment of the tool parts and/or the guide wheels or guide rollers, the lower module part preferably has at least one lower body of rotation, which holds the lower tool part and/or the lower guide wheel and which has a lower drive channel, within which the lower drive shaft is held positively but axially displaceably. The upper module part preferably has at least one upper body of rotation, which holds the upper tool part and/or the upper guide wheel and which has an upper drive channel, within which the upper drive shaft is held positively but axially displaceably. The preferably ring-shaped tool parts can therefore be adapted to the body of rotation, which in turn interacts positively with the associated drive shaft. In this way, tool parts, which are normally made of high quality materials, can have simpler and smaller dimensions.

By means of the inventive apparatus, various processing operations can be carried out on flat objects. Flat objects can for example be grooved, perforated or cut. Differently configured tool modules can be used, so that different machining processes can be combined as desired.

The inventive apparatus can be used particularly advantageously for cutting flat objects. For this purpose, the lower tool part and the upper tool part are designed as rotating blades. The rotary blades have peripheral cutting edges that can act on the flat objects from above and below. Preferably, the cutting edges overlap so that the flat object can be completely cut through. It is also possible that only one of the blades penetrates the transport plane along which the flat objects are transported. The rotary blades can be identical in design and may have identical functions. However, the blades can be designed in any way, so that cutting and shearing processes can be performed. Preferably, both tool parts or both rotary blades are directly driven. However, one of the tool parts can also be used as a follower, while the other tool part is actuated.

Of particular importance for the precise processing of flat objects is the precise and stable design of the tool modules. In a preferred design the tool module has a casing with a central shell, which has a lower central shell part provided with a lower central opening and an upper central shell part provided with an upper central opening. The parts of the central shell, i.e. the lower and upper lower central shell parts, are integrally connected to each other by a connecting bridge. The connecting bridge is connected on the input side in the direction of transport to a working channel into which the lower tool part arranged in the lower central opening and the upper tool part arranged in the upper central opening project peripherally. The connecting bridge connects on its output side to a first output channel on its bottom side and to a second output channel on its top side. Flat objects, which are transported in the direction of transport through the input channel into the tool module, are cut open in the working channel and separated into two object parts, of which the first object part is led away through the first output channel and the second object part through the second output channel. The one-piece connection of the two central shell parts results in a precise arrangement of the tool parts and the guide rollers. The flat objects can be precisely machined without the need for prior adjustments. Due to the one-piece construction of the central shell part, it can be machined with little effort without the need for further assembly work. The lower and the upper central shell part, however, can also be manufactured separately and can be detachably connected to each other by mechanical elements. For high-precision instruments, however, one-piece central shell parts are preferred.

In the work processes, separated parts of the flat object can be further processed or even removed. An object part, which forms the edge of a flat object, is usually not further processed, but carried away as waste. Usually such waste is led away downwards into a container, which is emptied from time to time.

The tool modules are designed according to the working process or purpose. Conventionally, tool modules for cutting the edge sections and tool modules for performing longitudinal cuts are provided. A conventional cutting device is therefore ordered with a large number of tool modules, each of which has a specific purpose and is used selectively. This is associated with a corresponding cost for manufacturing, procurement and storage of the numerous tool modules.

In order to avoid these disadvantages, the invention provides that the lower central shell part has a lower receiving chamber in which a lower guide shell is fixed, and that the upper central shell part has an upper receiving chamber in which an upper guide shell is arranged. Furthermore, it is provided that the lower guide shell and the upper guide shell limit the first output channel through which an object part is led away or forwarded. The central shell part can therefore be equipped with a lower and an upper guide shell, which limit a desired output channel. A tool module can therefore be converted within a few minutes by replacing the guide shells. The user of the apparatus does not have to keep a large number of tool modules at hand, but can adapt his tool modules to a current machining process within a short time by exchanging the guide shell.

The number of tool modules used depends on the number of longitudinal cuts to be inserted into a flat object. Preferably, a first and a second tool module are coupled to the lower and upper drive shaft and are held detachable by an assigned first and second tool carrier. The tool carriers are in turn each coupled to an assigned, preferably lower or upper setting shaft. For example, two tool modules are provided, with which an edge can be cut away from the flat object on both sides. Preferably, several processing stages are arranged one behind the other in the direction of transport, each of which has one, two or more tool modules that are designed or equipped according to the working process and are coupled with at least one drive shaft. In the different processing stages, identical groups of tool modules, tool carriers, drive shafts, control shafts and guide rails, which are, however, individually equipped and/or adjusted and/or configured and/or operated, can thus be used to fulfil the functions assigned to the respective processing stages.

As mentioned above, the tool modules perform machining of the flat module, especially in the longitudinal direction. Following the processing stages, in which longitudinal cuts are inserted into the flat object, preferably at least one processing stage is provided, in which the flat object or the separated object parts are processed in transverse direction or transversely, e.g. cut, creased, or folded.

In a preferred embodiment, the only one drive shaft or the lower and the upper drive shafts, which are preferably coupled by gears, are coupled to the conveyor rollers of the transport system, so that the only one drive shaft or the lower and the upper drive shafts and the conveyor rollers rotate synchronously with each other. Preferably the conveyor rollers and the drive shafts of each processing stage are coupled together by gear wheels, wherein one of the gear wheels of each processing stage is preferably connected to a drive roller coupled to a drive belt. Instead of a central drive belt, local drive motors can also be provided.

For the drive of each setting shaft, which is preferably connected to the associated tool carrier as a spiral shaft or threaded rod, a setting motor is preferably provided, by means of which the associated tool carrier can be moved along the coupled setting shaft and thus the tool module held by the tool carrier can be moved along the associated only one drive shaft or the lower and upper drive shafts. The tool modules can therefore be positioned as desired by individually actuating the setting motors.

The apparatus preferably comprises a control unit, by means of which the working processes can be controlled, the setting motors can be actuated and the tool modules can be positioned, and the drive motors of the transport system can be activated or controlled. Preferably, sensors are assigned to the tool modules, by means of which the respective equipment of the apparatus can be identified and taken into account in the execution of the work processes.

Figure 3:
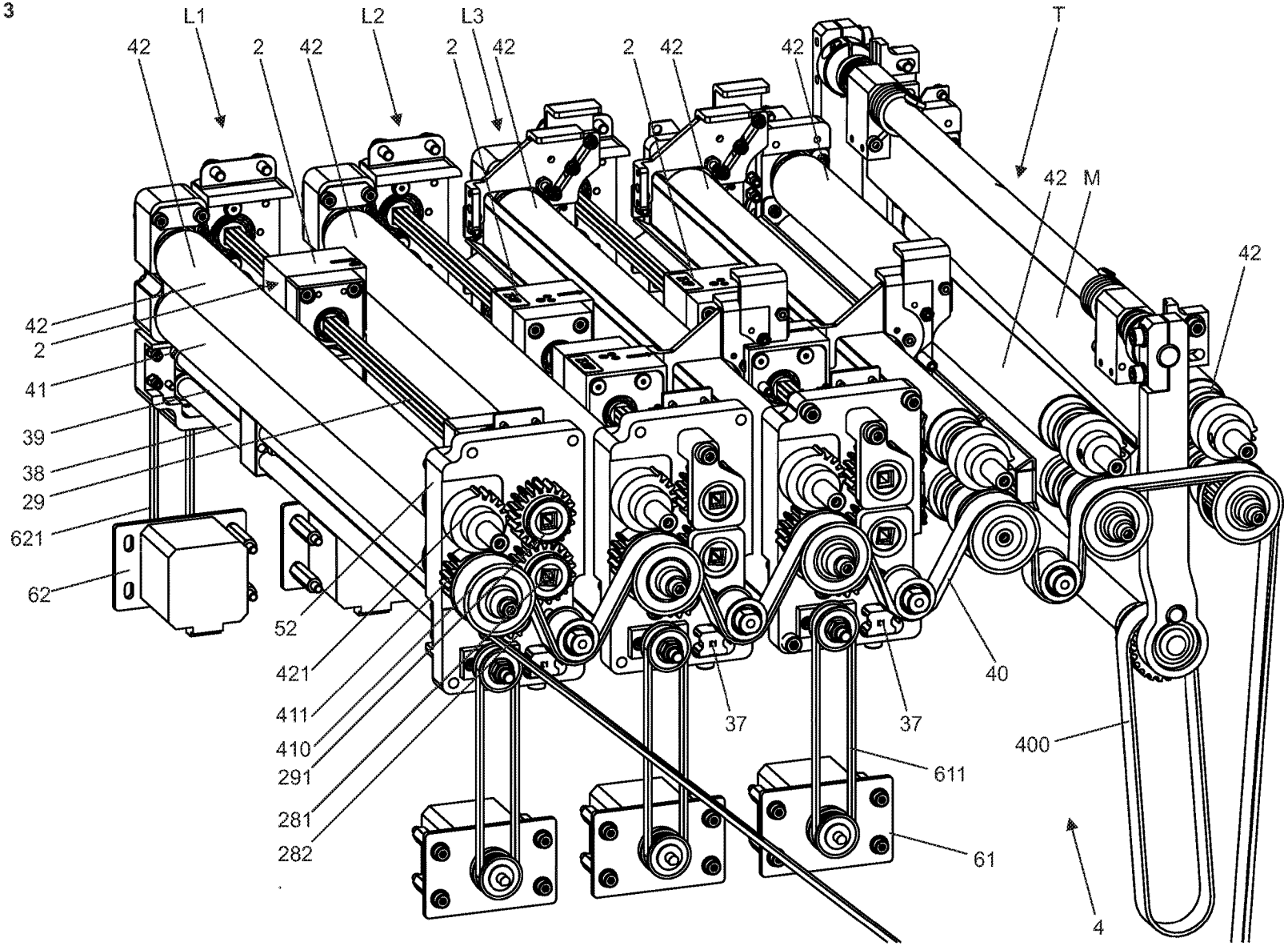
Figure 4:
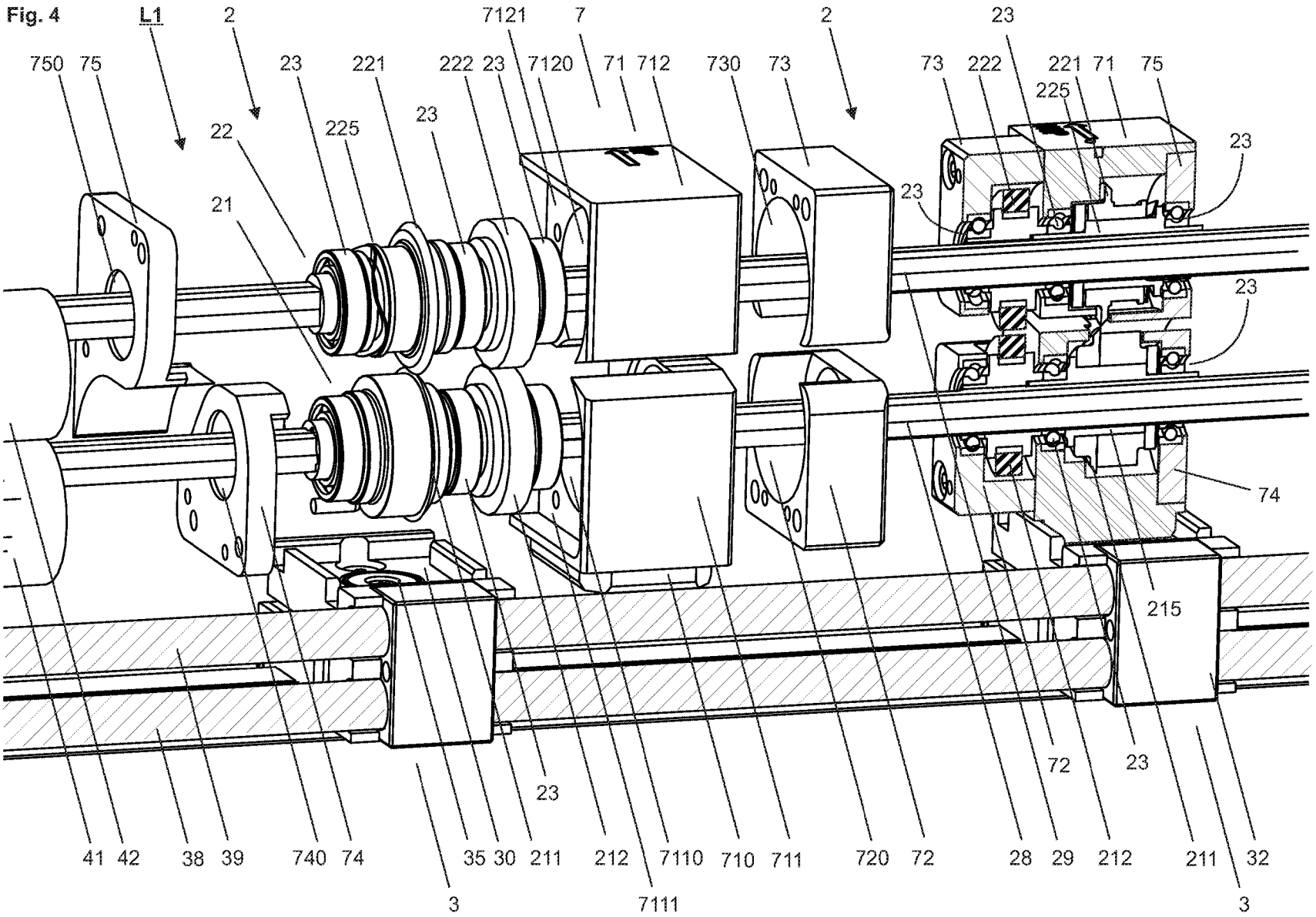
Figure 5B:
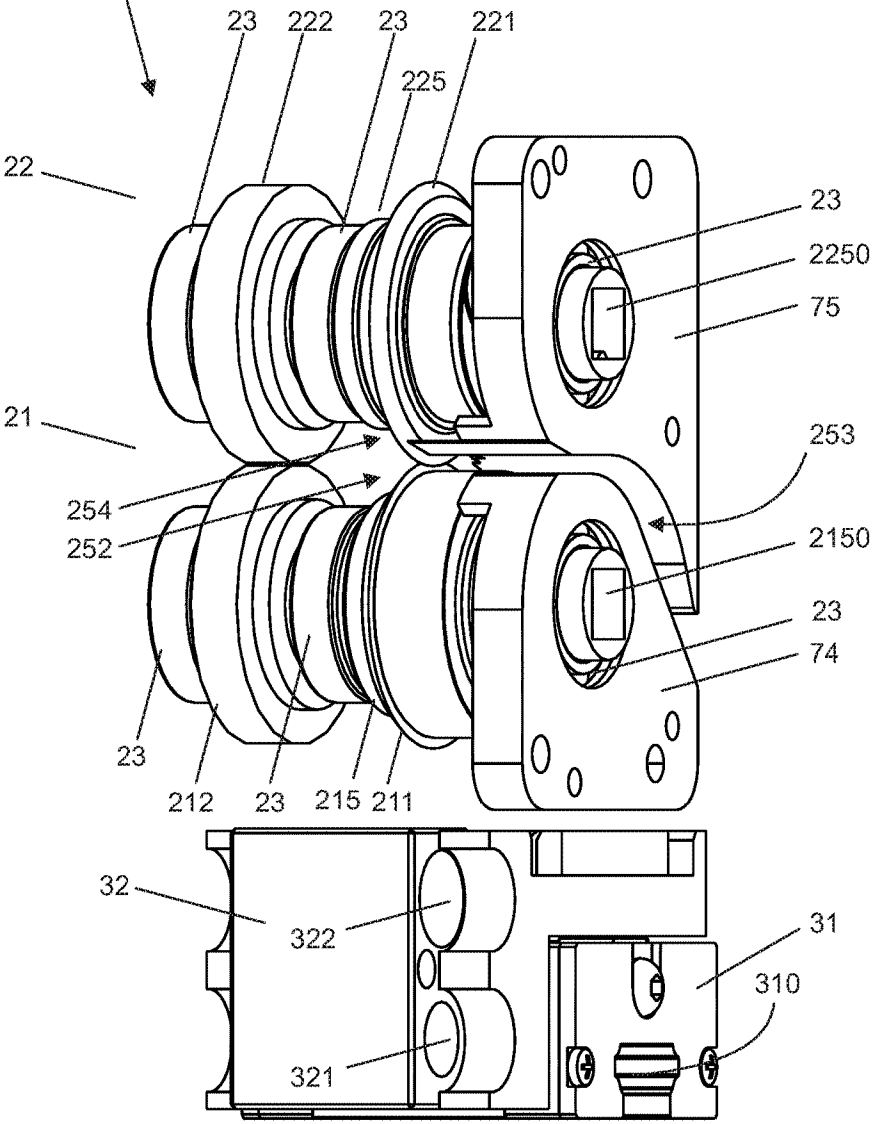
Figure 5A:
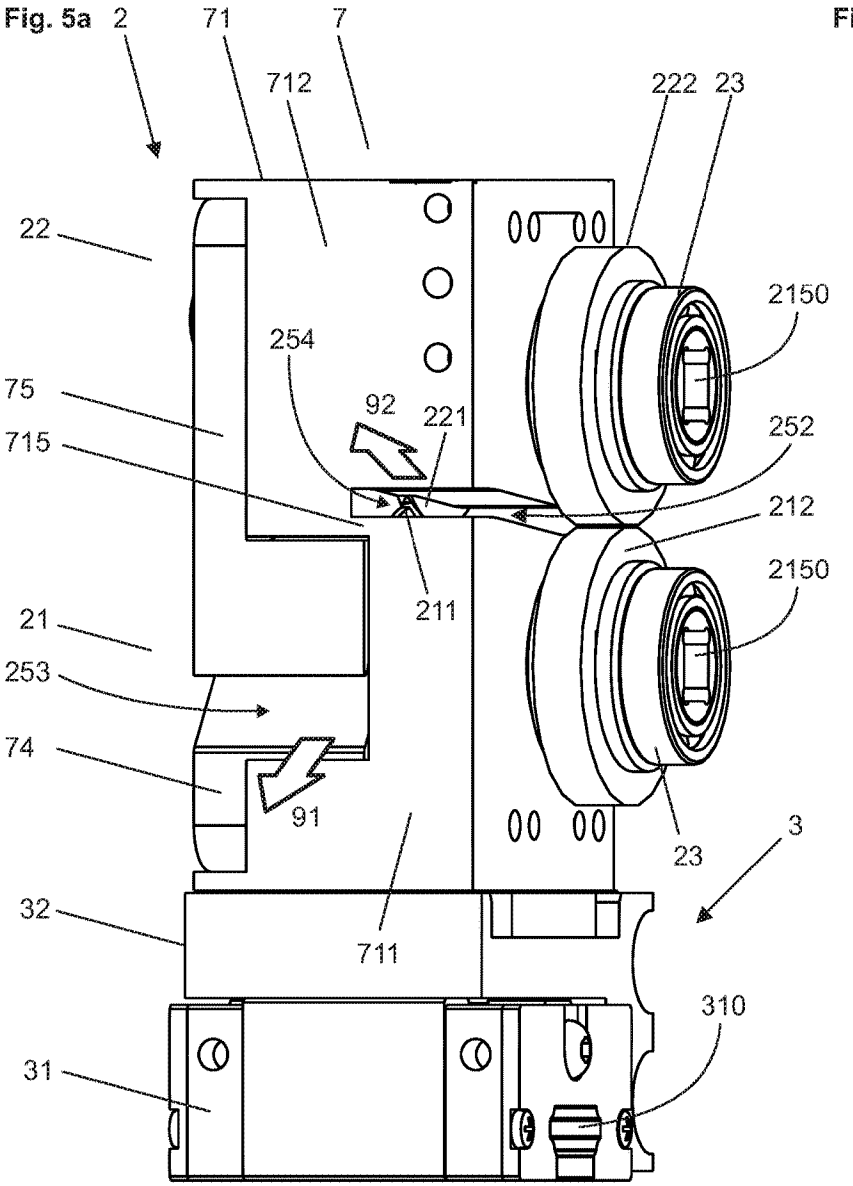
Figure 6B:
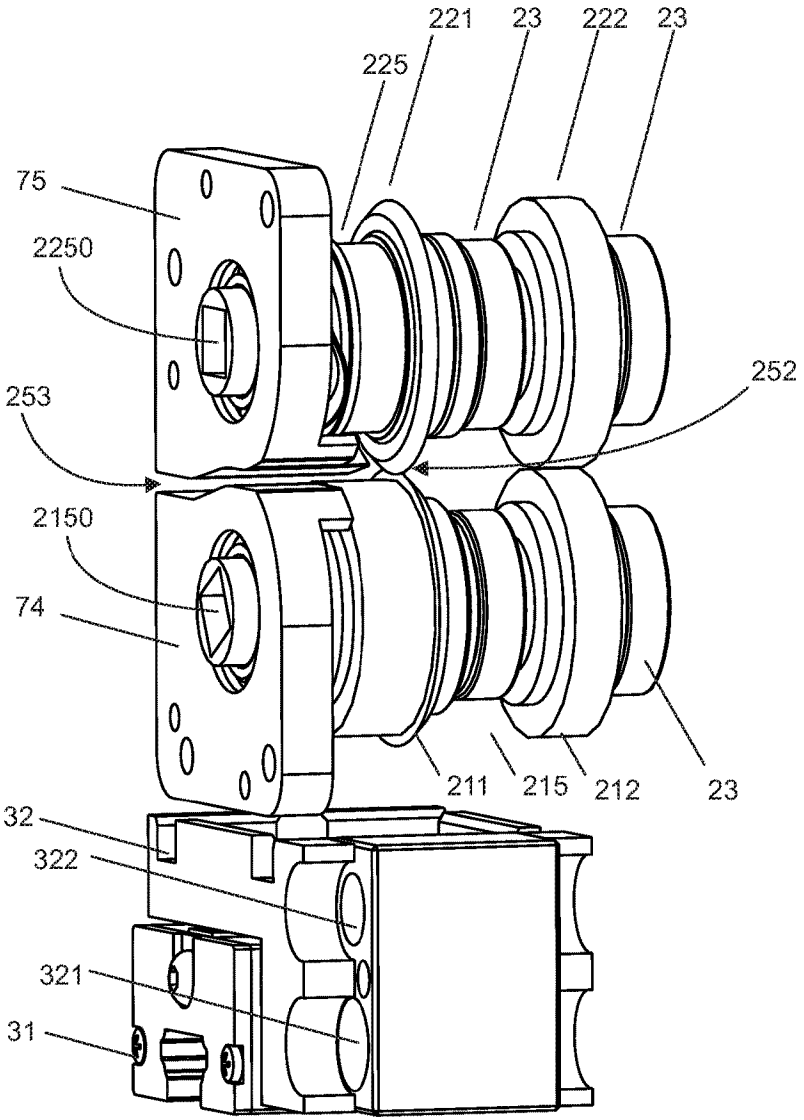
Figure 6A:
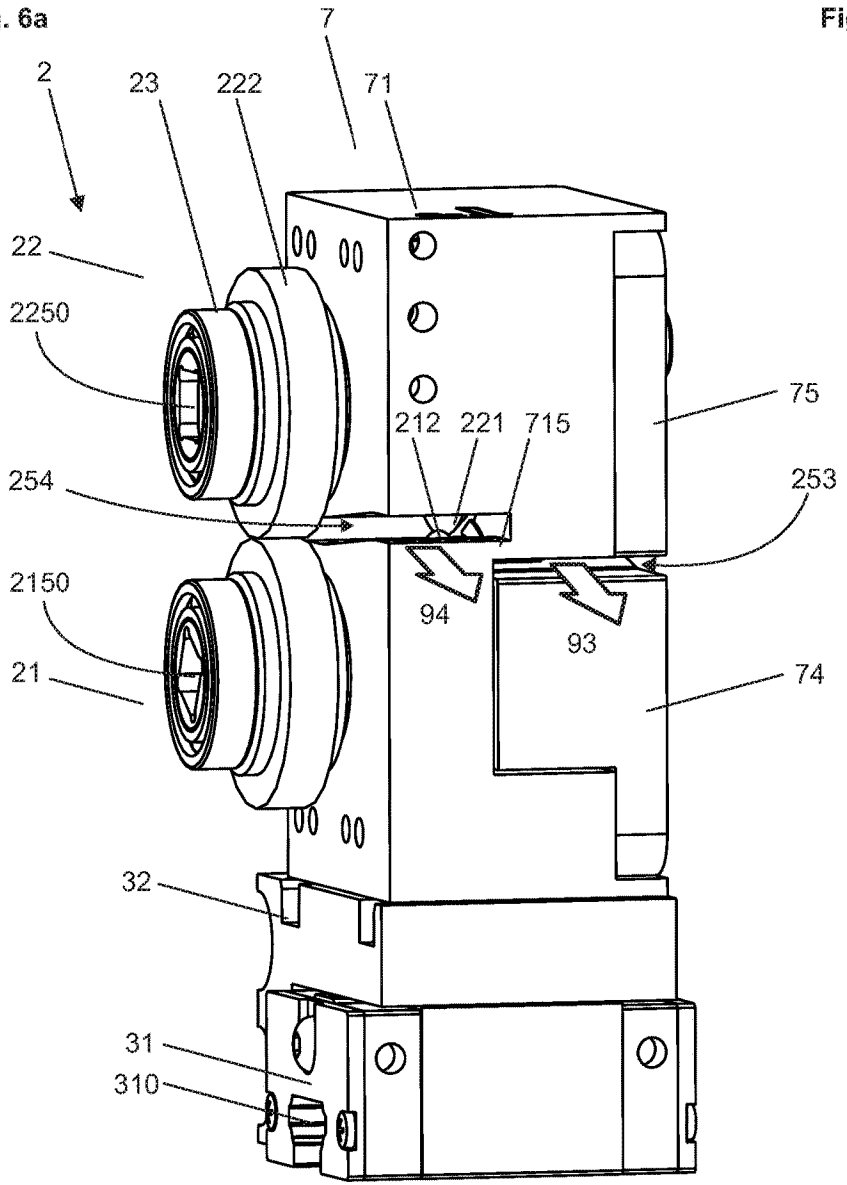

Below, the invention is explained in more detail with reference to the drawings. Thereby shows:

FIG. 1 an inventive apparatus 1 for processing flat objects 9 comprising a transport system 4 with a plurality of rotatably mounted conveyor rollers 41, 42, by means of which the flat objects 9 can be transported in the direction of transport, and a plurality of tool modules 2, which are provided in different processing stages L1, L2, L3 for processing the flat objects 9;

FIG. 2*a* the apparatus 1 of FIG. 1 cut along line A-A with a view to the exit side of the third processing stage L3, in which two tool modules 2 are coupled with a lower and an upper drive shaft 28, 29 which are rotatably and slidably mounted and held in position by a locking part 55, and which are each held by associated tool carriers 3 slidable along a common guide rail 37;

FIG. 2*b* the apparatus 1 of FIG. 2*a* with the locking part 55 released, the lower and upper drive shafts 28, 29 pulled out and a tool module 2 removed from the associated tool carrier 3;

FIG. 2*c* the tool carrier 3 of FIG. 2*b* shown from above, from which the related tool module 2 has been removed;

FIG. 3 the processing stages L1, L2, L3 and an adjacent cutting device T with a view to the transport system 4 provided at the rear of the apparatus 1 of FIG. 1;

FIG. 4 one of the processing stages L1 with sectioned conveyor rollers 41, 42; with a first tool module 2 in exploded view; with a second tool module 2 in sectional view and with the associated tool carriers 3, which are passed through by two setting shafts 38, 39 and each of which can be displaced by means of one of the setting shafts 38, 39;

FIG. 5*a* one of the tool modules 2 of the first processing stage L1 of FIG. 1, comprising a casing 7 with a central shell 71;

FIG. 5*b* the tool module 2 of FIG. 5*a* after removing the central shell 71;

FIG. 6*a* one of the tool modules 2 of the second or third processing stage L2, L3 of FIG. 1, comprising a casing 7 with a central shell 71 as shown in FIG. 5*a;*

Figure 7B:
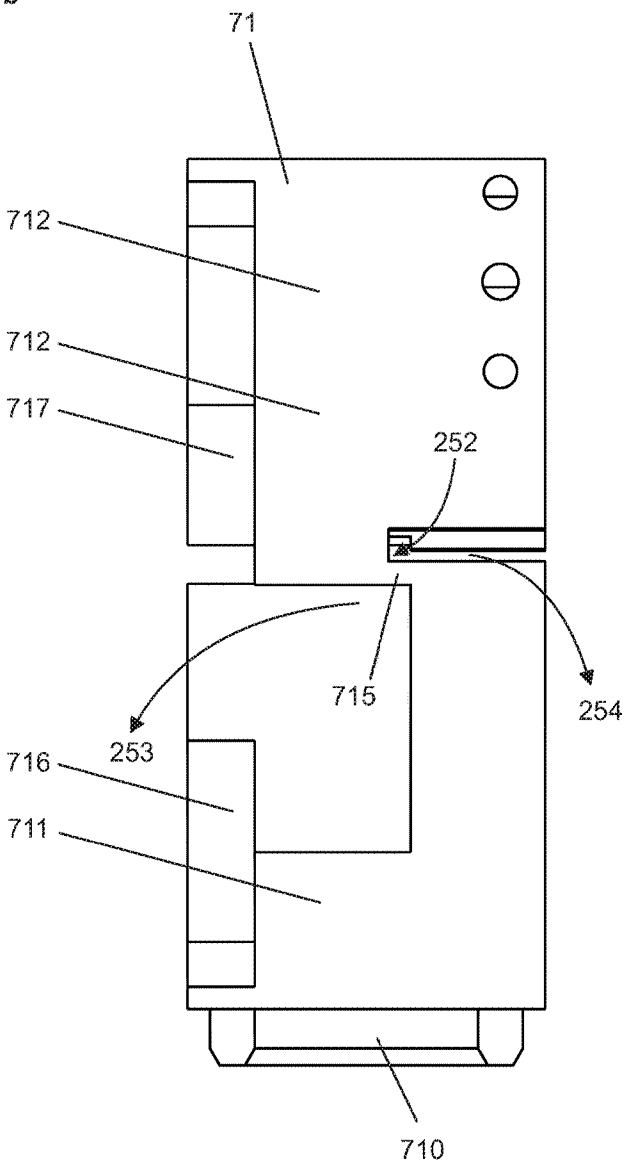
Figure 7A:
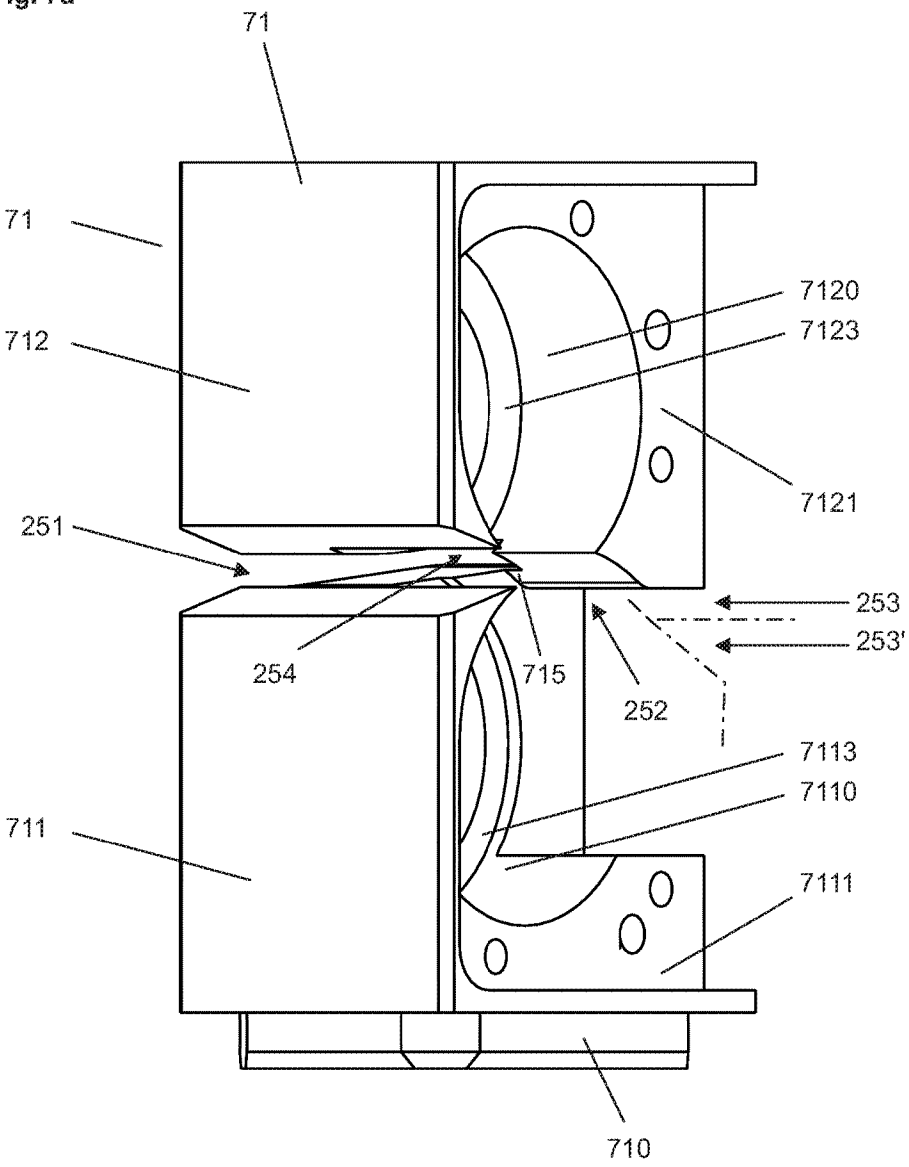

FIG. 6*b* the tool module 2 of FIG. 6*a* after removing the central shell 71;

FIG. 7*a* the central shell 71 of FIG. 5*a* or FIG. 6*a* in a spatial representation viewed from the input side with an input channel 251 visible, into which flat objects 9 can be inserted; and FIG. 7*b* the central shell 71 of FIG. 7*a* viewed from the output side with output channels 253 and 254 visible, from which separate object parts 91, 92 and 93, 94 are led away.

FIG. 1 shows an inventive apparatus 1 for processing flat objects 9, especially paper sheets, cardboard, plastic films and the like. The flat objects 9 are fed into the apparatus 1 on the input side, transported by means of a transport system 4, processed in four processing stages L1, L2, L3, T and, after processing, deposited in an assorted manner on a tray 15, separated by divider plates 151, 152.

The housing 100 of apparatus 1, which is shown only schematically, preferably includes doors or windows that can be opened by sliding or hinged devices to access the relevant parts of apparatus 1 for setting, configuration and/or maintenance. Preferably, the side shown is accessible and the processing stages L1, L2, L3 are accessible from above.

Each of the processing stages L1, L2, L3 in this preferred embodiment of the apparatus 1 comprises two tool modules 2, which are equipped with interacting tool parts 211, 221 (see FIG. 4) and which can be driven by drive shafts 28, 29. The tool modules 2 of each processing stage L1, L2, L3 can be moved along the drive shafts 28, 29 by means of setting shafts 38, 39 (see FIG. 2*a*). The setting shafts 38, 39 can be driven by setting motors 61, 62 and/or at least one setting belt 611, 621 (see FIG. 2*a* and FIG. 3).

The apparatus 1 comprises a transport system 4 (see FIG. 3) with several pivoted conveyor rollers 41, 42, which are arranged in pairs and by means of which the flat objects 9 can be transported in the direction of transport. The conveyor rollers 41, 42 are driven by a main motor 45, which drives a central belt 40 via a transmission belt 49 and a gear unit 44. In this preferred embodiment, the central belt 40 drives not only the conveyor rollers 41, 42, but also the drive shafts 28, 29.

Below as an example tool modules 2 are described, which are provided for cutting flat objects. Likewise, tool modules 2 can be used to crease, perforate or otherwise process flat objects.

On the flat object 9 shown in FIG. 1, a sheet of paper, lines are drawn along which the paper sheet 9 is to be cut lengthwise and crosswise. It can be seen that six longitudinal cuts S1, . . . and several transverse cuts Q1 are to be made to cut out rectangles or cards K4 and place them in tray 15 between divider plates 151, 152. Between the rectangles or cards K4 and at the edge of the paper sheet 9, paper strips may remain which are to be removed as waste. Preferably, this waste is led away downwards and collected in a container located underneath unit 1, e.g. in housing 100.

Depending on the cuts to be made, it is therefore possible that cut-off object parts 91, 92 can be moved to the next processing stage L2, L3, T or moved downwards. The deflection of the object parts 91, 92 can be done by sliders or advantageously by the tool modules 2 themselves.

The user can decide how the flat object 9 should be processed. Depending on the selected working process, apparatus 1 has to be configured. For this purpose, apparatus 1 is to be equipped with the appropriate tool modules 2, 2A, which are then moved to the positions where a cut is to be made by driving setting shafts 38, 39 in each processing stage L1, L2, L3. The processing stages L1, L2, L3 are to be equipped with the required number of tool modules 2 according to the defined cutting pattern. One or two tool modules 2 can be inserted in the shown apparatus. If further tool modules 2 are to be inserted, a corresponding number of additional setting shafts is required.

It is described below that tool modules 2 can be configured so that according to the selected configuration the separated object parts 91, 92 are forwarded to the next processing stage L2; L3, T or moved downwards and away.

As an example, it is shown that the tool module 2A executes the longitudinal cut S1, which separates the object parts 91, 92 from each other. The object part 91 is the separated edge of sheet 9, which should be led downwards and away. The object part 92 is a longitudinal strip that is divided into individual cards in the fourth processing stage T.

The fourth processing stage T serves therefore for making transverse cuts, in particular to separate the front and back edges of sheet 9 and to separate the longitudinal strips into individual cards K4. As an example, the cutting line Q1 is shown, along which the back edge of paper sheet 9 is cut off.

A control unit 8 is provided to monitor and control the processes taking into account the current configuration of apparatus 1. Sensors 81 are used to check which tool modules 2 are used. The identification can be optically, magnetically or electromagnetically. An identification program ensures that the tool modules 2 are moved aside to the sensors 81 and identified there. As soon as the configuration of the apparatus 1 with the tool modules 2 is determined, the tool modules 2 are moved according to the instructions selected by the user to the corresponding positions where the longitudinal cuts are to be made. For this purpose, the setting motors 61, 62 are operated by the control unit 8. Then the transport system 4 is activated with the main motor 45. For the correct execution of the longitudinal cuts and cross sections, additional sensors are preferably provided, which detect the position of the paper sheet 9 and control the processing stages L1, L2, L3, T accordingly.

The processing stages L1, L2, L3, T are held by a rack or chassis 10 of apparatus 1, which has a front mounting plate 11 and a rear mounting plate 12 connected by cross bars 13.

FIG. 2*a* shows the apparatus 1 of FIG. 1 cut along line A-A looking at the output side of the third processing stage L3, which is essentially the same as the first two processing stages L1, L2. The processing stages L1, L2, L3 are preferably interchangeable, but can be configured and set differently to perform the required processing in each stage.

The processing stage L3 has a front bearing plate 51 and a rear bearing plate 52, between which a lower and an upper drive shaft 28, 29; a lower and an upper setting shaft 38, 39; and a lower and an upper conveyor roller 41, 42 are rotatably mounted. The lower and upper drive shafts 28, 29 are supported on both sides in drive shaft bearings 280, 290. The lower and upper setting shaft 38, 39 are supported on both sides by setting shaft bearings 380, 390. In addition, a guide rail 37 is held stable between the front and rear bearing plate 51, 52.

As shown in FIG. 3, the lower and upper drive shafts 28, 29 of each processing stage L1, L2, L3 are coupled together on the rear of apparatus 1 by an upper and a lower shaft gear wheel 281, 291. The lower shaft gear wheel 281 is coupled by an intermediate gear wheel 282 to a lower roller gear wheel 411, which is rotationally fixed to the lower conveyor roller 41 and rotationally fixed to a drive roller 410 driven by the central belt 40.

FIG. 3 shows further that the lower setting shaft 38 of each processing stage L1, L2, L3 is coupled to the lower setting motor 61 via a lower setting belt 611 on the rear side. The upper setting shaft 39 is coupled to the upper setting motor via an upper setting belt 621 on the front side.

Furthermore it is shown that the fourth processing stage T can be driven by an auxiliary belt 400.

FIG. 2*a* shows further that the two tool modules 2 each have a lower module part 21 pierced by the lower drive shaft 28 and an upper module part 22 pierced by the upper drive shaft 29. It is shown that the asymmetrical tool modules 2 are facing each other and can therefore be mounted optionally.

FIG. 5*b* shows that in the lower module part 21 a lower tool part or a lower rotary blade 211 is arranged, and in the upper module part 22 an upper tool part or an upper rotary blade 221 is arranged. The lower tool part 211 is held by a lower body of rotation 215 and the upper tool part 225 is held by an upper body of rotation 225. The lower body of rotation 215 has a lower drive channel 2150 running along its axis of rotation, which is pierced by the lower drive shaft 28. The upper body of rotation 225 has an upper drive channel 2250 running along its axis of rotation, pierced by the upper drive shaft 29. In this preferred design, both tool parts 211 and 221 of tool modules 2 are directly driven. In simpler designs according to the invention, however, only one drive shaft may be provided, which directly drives only the first tool part and, if necessary, indirectly the second tool part, which operates as a follower.

FIG. 2*a* shows further that each of the tool modules 2 sits on a tool carrier 3 and is held detachably by it. The tool carriers 3 are positively held by the guide rail 37 and can be moved axially along it. Furthermore, the tool carriers 3 are each penetrated by both setting shafts 38, 39, which are designed as spindles or threaded rods. The first tool carrier 3 is coupled with the lower setting shaft 38 by a screw thread and the second tool carrier 3 is coupled with the upper setting shaft 39 by a screw thread. The two tool carriers 3 are individually movable along the guide rail 37 by turning the coupled lower or upper setting shaft 38; 39.

The upper and lower drive shafts 28, 29 can be pulled out of the unit 1, while the tool modules 2 rest on the corresponding tool carriers 3. For this purpose, a locking part 55 is released by turning a locking element 56 and is pushed aside and thereby released from a lower locking piece 289 provided on the front of the lower drive shaft 28 and from an upper locking piece 299 provided on the front of the upper drive shaft 29. The locking of the lower and upper drive shafts 28, 29 is thereby released so that they can be pulled out axially from the apparatus 1.

FIG. 2*b* shows unit 1 of FIG. 2*a* with locking part 55 released, lower and upper drive shafts 28, 29 pulled out and tool module 2 removed from the associated tool carrier 3. The removed tool module 2 can be replaced or reconfigured and serviced and reinstalled in the tool carrier 3. The second tool module 2 remains in tool carrier 3. Preferably, the tool modules 2 are held stable in the tool carriers 3 in such a way that they remain stable in position when the two drive shafts 28, 29 are pulled out. The user can therefore pull out the drive shafts 28, 29 in a first step and only in a second step remove, reconfigure, repair or clean the tool modules 2 individually and then reinsert them. Preferably, the upper and lower drive shafts 28, 29 are axially guided so that they can be pushed axially back into the apparatus 1 and coupled with the tool modules 2 again without further effort. Finally, the locking part 55 is pushed against the locking pieces 281, 291 and fixed by means of the locking element 56. The newly inserted tool modules 2 are then moved into their assigned positions using the setting shafts 38, 39.

The steps for removing the tool modules 2 are marked A, B and C. In step A (see FIG. 2*a*) the locking part 55 is released. In step B (see FIG. 2*b*) the drive shafts 28, 29 are pulled out and in step C (see FIG. 2*b*) the tool module 2 is removed from the tool carrier 3.

FIG. 2*c* shows the tool carrier 3 of FIG. 2*b*, from which one of the tool modules 2 has been removed. In this exemplary design, the tool carrier 3 comprises a slide part 31, which is positively connected to the guide rail 37 and can be moved axially along it. For this purpose, the slide has a receiving channel 310, whose cross-section is adapted to the cross-section of the guide rail 37 (see e.g. FIG. 5*a*). The receiving channel 310 and the guide rail 37 each have a T-shaped cross-section. The carriage 31 is therefore held by the guide rail 37 with practically no play and can be moved along it. A receiving part 32 is screwed to the slide part 31, which has a holding room 30 on the upper side for holding the associated tool module 2. FIG. 2*b* shows that the removed tool module 2 has a base 710, which can be inserted into the holding room 30 and is held there by mechanical holding elements 325 and a magnetic holding element 35. The mechanical holding elements 325 form a collar, which prevents the lateral displacement of the base 710. Furthermore, a magnet 35 is recessed into the receiving part 32, which interacts with the ferromagnetic or paramagnetic base 710 and holds it in the holding room 30, so that tool module 2 can only be released under vertical force. The mechanical and magnetic holding devices 325, 35 prevent the tool module 2 from becoming loose on the tool carrier 3 when the lower and upper drive shafts 28, 29 are pulled out.

FIG. 2*c* further shows that the receiving part 32 has a lower coupling channel 321 through which the lower setting shaft 38 passes, and an upper coupling channel 322 through which the upper setting shaft 39 passes. In one of the coupling channels 321, 322 a thread is provided which interacts with the corresponding setting shaft 38 or 39.

FIG. 3 shows the processing stages L1, L2, L3 and an adjacent cutting device T with a view to the transport system 4, which is provided at the rear of the apparatus 1 of FIG. 1. It is shown that the central belt 40 of transport system 4 synchronously drives the conveyor rollers 41, 42 of all processing stages L1, L2, L3, T and the drive shafts 28, 29 of the processing stages L1, L2, L3. At each of the processing stages L1, L2, L3, the central belt 40 drives a drive roller 410, which is arranged coaxially to a lower roller gear wheel 411 of the lower conveyor roller 41 and is connected to it. The lower roller gear wheel 411 drives on the one hand an upper roller gear wheel 421 of the upper conveyor roller 42 and on the other hand an intermediate gear wheel 282, which drives the lower shaft gear wheel 281 of the lower drive shaft 28, which in turn is coupled to the upper shaft gear wheel 291 of the upper drive shaft 29. The fourth processing module T, which has a cutting blade M, by means of which transverse cuts are made, is driven via an auxiliary belt 400 and by an auxiliary motor (not shown) controlled by the control unit 8.

FIG. 4 shows a part of processing stage L1 with sectioned conveyor rollers 41, 42, with a first tool module 2 in exploded view, with a second tool module 2 in sectional view and with the associated tool carriers 3, which are passed through by two setting shafts 38, 39 and which can each be moved by one of the setting shafts 38, 39.

Each of the tool modules 2 has a five-part casing 7 with a central shell 71, to which a lower bearing shell 72 and an upper bearing shell 73 can be connected or screwed on one side and a lower guide shell 74 and an upper guide shell 75 on the other side.

As shown in FIG. 4 and FIG. 7*a*, the central shell 7 has a lower central shell part 711 with a lower central opening 7110 connected to a lower bearing ring 7113 on one side and a lower receiving chamber 7111 on the other side, and an upper central shell part 712 with an upper central opening 7120 connected to an upper bearing ring 7123 on one side and an upper receiving chamber 7112 on the other side. The lower central shell part 711 is further provided with a socket 710 at its bottom side, which can be inserted into holding room 30 of the associated tool carrier 3.

The lower and upper bearing shell 72, 73 are screwed to one side of the central shell 71. On the other side, the lower guide shell 74, which has a lower bearing opening 740, is inserted and screwed into the lower receiving chamber 7111. The upper guide shell 75, which has an upper bearing opening 750, is inserted and screwed into the upper receiving chamber 7121. The lower guide shell 74 and the upper guide shell 75 limit an output channel, which can be designed as required by the design of the guide shells 74, 75, e.g. an output channel which extends approximately straight or downward. Depending on the requirements, a lower and upper guide shell 74, 75 can be connected to the central shell 71 to define an output channel as required for the planned machining process.

The section through the second tool module 2 in parallel to the drive shafts 28, 29 in FIG. 4 shows that the lower tool part 211 is mounted on a lower body of rotation 215 and the upper tool part 221 is mounted on an upper body of rotation 225. The lower body of rotation 215 with the lower tool part 211 is located in the lower central opening 7110 of the lower central shell part 711 and is supported on one side by a ball bearing 23 in the lower bearing ring 7113 of the lower central shell part 711 (see FIG. 7*a*) and on the other side by a ball bearing 23 in the bearing opening 740 of the lower guide shell 74. The upper body of rotation 225 with the upper tool part 221 is located in the upper central opening 7120 of the upper central shell part 712 and is supported on one side by a ball bearing 23 in the upper bearing ring 7123 of the upper central shell part 712 (see FIG. 7*a*) and on the other side by a ball bearing 23 in the bearing opening 750 of the upper guide shell 75. The lower guide wheel 212 is supported by a ball bearing 23 in a bearing opening of the lower bearing shell 72 and by a ball bearing 23 in the lower bearing ring 7113 of the lower central shell 711. The body of the lower guide wheel 212 and the lower body of rotation 215 overlap at this point. The upper guide wheel 222 is supported by a ball bearing 23 in a bearing opening of the upper bearing shell 73 and by the ball bearing 23 in the upper bearing ring 7123 of the upper central shell 712. The body of the upper guide wheel 222 and the upper body of rotation 225 overlap at this point.

The lower tool part 211 and the lower guide wheel 212 as well as the upper tool part 221 and the upper guide wheel 222 are therefore connected to each other in a stable way and are arranged close to each other. The flat object 9 is stably guided in one plane by the guide wheels 212, 222 and can therefore be precisely machined by the adjacent tool parts 211, 221.

FIG. 5*a* shows one of the tool modules 2 of the first processing stage L1 of FIG. 1 from the output side. The tool module 2 has a casing 7 with a central shell 71, which has already been described in part with reference to FIG. 7*a*. The upper and lower bearing shells 72, 73 have been removed to expose the guide wheels 212, 222 which are connected to a bearing element 23 on each side. On the other side the lower and upper guide shells 74, 75 are inserted, limiting a first output channel 253. On the other side, a second output channel 254 is provided between the lower central shell part 711 and the upper central shell part 712. The lower and the upper central shell parts 711, 712 are integrally connected by a connecting bridge 715 only. This connecting bridge 715 joins the first output channel 253 at its bottom and the second output channel at its top. On the input side a working channel is provided in front of connecting bridge 715, into which the lower tool part 211 and the upper tool part 221 peripherally extend. The flat object 9 supplied on the input side is divided into a first object part 91 and a second object part 92 in working channel 252 before reaching connecting bridge 715. The first object part 91 is led under connecting bridge 715 down through the first output channel 253. The second object part 92 is led over connecting bridge 715 through the second output channel 254 and further processed in further processing stages L2, L3, T. It should be noted that the first and second output channels 253, 254 partially overlap, so that there is enough space to transport the object parts 91, 92.

The tool module 2 is mounted on a tool carrier 3, which comprises the carriage 31 with the receiving channel 310 and the receiving part 32.

FIG. 5*b* shows the tool module 2 of FIG. 5*a* after removing the central shell 71, looking at the input side. It can be seen that the tool parts 211, 221 slightly overlap each other within the working channel 252, so that supplied flat objects 9 can be fed completely separated to the output channels 253, 254. In FIG. 5*b* it is shown that the course of the first output channel 253 depends exclusively on the shape of the lower and upper guide plates 74, 75. Therefore, guide plates 74, 75 can be provided for different first output channels 253 and connected to the central shell 71 as required.

FIG. 6*a* shows one of the tool modules 2 of the second or third processing stage L2, L3 of FIG. 1, which comprises a casing 7 with a central shell 71 as shown in FIG. 5*a*. The central shell 71 is equipped with a lower guide shell 74 and an upper guide shell 75, which define a first output channel 253, which has a different course than the output channel 253 of tool module 2 of FIG. 5*a*. From this tool module 2, a flat object 9 is divided into two object parts 93, 94, which are both fed straight to the next processing stage L3 or T. The first output channel 253 is again below connecting bridge 715 and the second output channel 254 is above connecting bridge 715. The object parts 93, 94 are thus discharged by tool module 2 with a slight difference in height corresponding to the thickness of connecting bridge 715 and are subsequently conveyed further at the same height.

FIG. 6*b* shows the tool module 2 of FIG. 6*a* from the input side after removing the central shell 71. It is shown that the first guide channel 253 runs slightly downwards, so that the separated object part 93 can be guided under the connecting bridge 715 to the next processing stage L3; T.

FIG. 7*a* shows the already described central shell 71 of FIG. 5*a* or FIG. 6*a* in a spatial representation with a view to the input channel 251. By equipping the central shell 71 with the guide shells 74, 75 of FIG. 5*b* or FIG. 6*b*, the central shell 71 or the respective tool module 2 can be configured for use in the first, second or third processing stage L1, L2, L3.

It is shown that the input channel 251 adjoins the working channel 252, which in turn adjoins the connecting bridge 715, which separates the first output channel 253 from the second output channel 254. Symbolically, different courses of the first output channel 253, 253' are shown.

FIG. 7*b* shows the central shell 71 of FIG. 7*a* from the output side with with a view to the first and second output channels 253 and 254, which overlap slightly in the area of the connecting bridge 715. Behind the connecting bridge 715 there is the working channel 252, in which the tool parts 211, 221 are engaged.

LIST OF REFERENCE SIGNS

1 apparatus, cutting device
10 rack
100 housing
11 front mounting plate
12 rear mounting plate
13 cross bars
15 tray
151, 152 divider plates
2 tool module
2A first tool module
21 lower module part
211 lower tool part, lower rotary blade
212 lower guide wheel, lower guide roller
215 lower body of rotation
2150 lower drive channel
22 upper module part
221 upper tool part, upper rotary blade
222 upper guide wheel, upper guide roller
225 upper body of rotation
23 bearing elements, ball bearing
2250 upper drive channel
251 input channel
252 working channel
253 first output channel
254 second output channel
28 lower drive shaft
280 lower drive shaft bearing
281 lower shaft gear wheel
282 intermediate gear wheel
289 lower locking piece
29 upper drive shaft
290 upper drive shaft bearing
291 upper shaft gear wheel
299 upper locking piece
3 tool carrier
30 holding room
31 slide part
310 receiving channel
32 receiving part
321 lower coupling channel
322 upper coupling channel
325 mechanical holding element, collar
35 magnetic holding element
37 guide rail
37 lower setting shaft
380 lower setting shaft bearing
39 upper setting shaft
390 upper setting shaft bearing
4 transport system
40 central belt
400 auxiliary belt for the fourth processing stage T
41 lower conveyor roller
410 drive roller
411 lower roller gear wheel
412 upper roller gear wheel
42 upper conveyor roller
44 gear unit
45 main motor
47 drive belt for the fourth processing stage
48 drive belt for the ersten drei processing stages
49 transmission belt
51 front bearing plates
52 rear bearing plates
55 locking part
56 locking element
61 first setting motors
611 first setting belt
62 second setting motors
621 second setting belt
7 casing
71 central shell
710 base part
711 lower central shell part
7110 lower central opening
7111 lower receiving chamber
7113 lower bearing ring
712 upper central shell part
7120 upper central opening
7121 upper receiving chamber
7123 upper bearing ring
715 connecting bridge
716 lower receiving opening
717 upper receiving opening
72 lower bearing shell
720 lower wheel chamber
73 upper bearing shell
730 upper wheel chamber
74 lower guide shell
740 lower bearing opening
750 upper bearing opening
75 upper guide shell
8 control unit
81 sensor
9 flat object, e.g. sheet of paper, cardboard, or plastic film
91 first object part
92 second object part
L1 first processing stage for longitudinal cuts
L2 second processing stage for longitudinal cuts
L3 third processing stage for longitudinal cuts
M knife
T fourth processing stage for transversal cuts

The invention claimed is:

1. Apparatus for processing flat objects comprising a transport system with several rotatably mounted conveyor rollers, with which the flat objects are transportable in the direction of transport, and a plurality of releasably mounted tool modules, a) which comprises a casing;

b) which is releasably coupled to only one drive shaft or to a lower and an upper rotatably mounted drive shaft;

c) which is supported displaceable along the only one drive shaft or the lower and the upper drive shaft; and d) which is equipped with two tool parts that are mounted in the casing and that are arranged for interacting with one another for processing the flat objects, of which tool parts at least one is drivable by the lower or the upper drive shaft;

wherein each tool module of the plurality of releasably mounted tool modules is supported on a respective tool carrier of a plurality of tool carriers which is individually displaceable by means of a rotatably mounted setting shaft of a plurality of setting shafts in parallel to the only one drive shaft or in parallel to the lower and the upper drive shafts, and wherein each tool carrier of the plurality of tool carriers has at least one holding element which serves for releasably holding the respective tool module of the plurality of releasably mounted tool modules.

2. Apparatus according to claim 1, wherein each tool carrier of the plurality of tool carriers has a slide part which is displaceable along a guide rail that is aligned in parallel to the setting shaft and in parallel to the only one drive shaft or the lower and the upper drive shaft, and which each tool carrier of the plurality of tool carriers is supported on the guide rail or positively connected to the guide rail.

3. Apparatus according to claim 1, wherein the at least one holding element is a mechanical holding element or a magnetic holding element or that at least one mechanical holding element and at least one magnetic holding element are provided.

4. Apparatus according to claim 1, wherein each tool module of the plurality of releasably mounted tool modules comprises a lower module part having a lower tool part releasably coupled to the lower drive shaft, and an upper module part having an upper tool part releasably coupled to the upper drive shaft, and that the lower tool part and the upper tool part have diameters, which are selected in such a way that the lower tool part can act on the flat object from below and the upper tool part can act on the flat object from above.

5. Apparatus according to claim 4, wherein the lower tool module has a lower guide wheel releasably coupled to the lower drive shaft, and that the upper tool module has an upper guide wheel releasably coupled to the upper drive shaft, and that the lower and the upper guide wheel have diameters which are selected in such a way that the lower guide wheel can act on the flat object from below and the upper guide wheel can act on the flat object from above.

6. Apparatus according to claim 4, wherein the lower module part has at least one lower body of rotation, which holds the lower tool part and, if present, the lower guide wheel and wherein the lower body of rotation has a lower drive channel, within which the lower drive shaft is positively engaged, but is held axially displaceably and/or that the upper module part has at least one upper body of rotation, which holds the upper tool part and, if present, the upper guide wheel, and wherein the upper body of rotation has an upper drive channel, within which the upper drive shaft is positively engaged, but is held axially displaceably.

7. Apparatus according to claim 4, wherein the lower tool part and the upper tool part are rotary blades.

8. Apparatus according to claim 1, wherein each tool module of the plurality of releasably mounted tool modules comprises the casing with a central shell, which comprises a lower central shell part provided with a lower central opening and an upper central shell part provided with a upper central opening, which lower central shell part and upper central shell part are integrally connected to one another by a connecting bridge, which connecting bridge in the direction of transport connects on the input side to a working channel, into which the lower tool part arranged in the lower central opening and the upper tool part arranged in the upper central opening project peripherally, and which connecting bridge in the direction of transport connects on the output side on its underside to a lower output channel and on its upper side to a upper output channel.

9. Apparatus according to claim 8, wherein the lower central shell part has a lower receiving chamber, in which a lower guide shell is mounted, and that the upper central shell part has an upper receiving chamber, in which an upper guide shell is mounted, and that the lower guide shell and the upper guide shell delimit the lower output channel.

10. Apparatus according to claim 1, wherein a first tool module is coupled to the only one drive shaft or to the lower and upper drive shaft and is releasably held by an associated first tool carrier, which is coupled by threaded elements to a lower setting shaft, and wherein a second tool module is coupled to the one or to the lower and upper drive shaft and is releasably held by an associated second tool carrier, which is coupled by threaded elements to an upper setting shaft.

11. Apparatus according to claim 1, wherein the only one drive shaft or each lower and the upper drive shaft is held at the front in a front bearing plate and at the rear in a rear bearing plate so as to be rotatable and displaceable and that the only one drive shaft or each lower and the upper drive shaft has at the front a locking piece which is detachably coupled to a locking part held by the front bearing plate.

12. Apparatus according to claim 1, wherein the only one drive shaft or the lower and the upper drive shafts, are coupled by a common drive belt to the conveyor rollers of the transport system, so that the only one drive shaft or the lower and the upper drive shafts and the conveyor rollers rotate synchronously with each other.

13. Apparatus according to claim 1, wherein each setting shaft, which is connected to the associated tool carrier of the plurality of tool carriers is coupled to a setting motor, by means of which the associated tool carrier of the plurality of tool carriers is displaceable along the coupled setting shaft and the tool module of the plurality of releasably mounted tool modules held by the respective tool carrier of the plurality of tool carriers is displaceable along the associated only one drive shaft or the lower and upper drive shaft.

14. Apparatus according to claim 1, wherein a plurality of processing stages are arranged one behind the other in the direction of transport, each of the processing stages comprising one or two tool modules of the plurality of releasably mounted tool modules which are designed or equipped according to the operation in the respective processing stage.

15. Apparatus according to claim 1, wherein a control unit is provided by means of which the transport system and the setting motors are controllable and in that the control unit is connected to sensors by means of which the installed tool modules can be identified.

16. Apparatus according to claim 1, wherein each tool carrier of the plurality of tool carriers is below the respective tool module of the plurality of releasably mounted tool modules.

* * * * *